United States Patent [19]

Roark, Jr.

[11] Patent Number: 5,037,093

[45] Date of Patent: Aug. 6, 1991

[54] POOLSIDE BASKETBALL GOAL

[76] Inventor: John L. Roark, Jr., 103 Smith St., Pittsboro, Ind. 46167

[21] Appl. No.: 472,703

[22] Filed: Jan. 31, 1990

[51] Int. Cl.[5] ..... A63B 63/08

[52] U.S. Cl. ..... 273/1.5 R; 248/161; 248/413

[58] Field of Search ..... 273/1.5 R, 1.5 A, 411; 248/161, 156, 413

[56] References Cited

U.S. PATENT DOCUMENTS

| | | | |
|---|---|---|---|
| 1,182,621 | 5/1916 | Bain | 248/413 |
| 2,284,967 | 6/1942 | Ray et al. | 248/161 X |
| 2,321,901 | 6/1943 | Eddy | 248/161 |
| 3,602,504 | 8/1971 | Chapman | 248/156 X |

FOREIGN PATENT DOCUMENTS

| | | | |
|---|---|---|---|
| 1132253 | 10/1956 | France | 273/1.5 R |

OTHER PUBLICATIONS

Modern Plastics Encyclopedia 1949, 11-1949, p. 107.

*Primary Examiner*—Paul E. Shapiro

*Attorney, Agent, or Firm*—Woodard, Emhardt, Naughton, Moriarty & McNett

[57] ABSTRACT

A poolside basketball goal for in-ground swimming pools with a backboard and hoop supported by a support having an extended horizontal component. A support is anchored in the ground by an anchor which is located more than 3 feet away from the in-ground pool and the extended horizontal component of the support is greater than 3 feet and is sufficiently long to laterally traverse the sidewalk to suspend the hoop over the pool. The support is moveable with respect to the anchor and may be pivoted away from the swimming pool so that the sidewalk around the swimming pool is free from impedance of pedestrian traffic by the horizontal component of the support. Locking mechanisms, such as set screws, allow for vertical telescopic adjustment as well as for locking the support pool in a selected angular position. The anchor includes radial members to resist rotation of the anchor embedded in concrete.

12 Claims, 4 Drawing Sheets

POOLSIDE BASKETBALL GOAL

BACKGROUND OF THE INVENTION

This invention relates generally to basketball type goals and more specifically to an improved poolside basketball goal.

The popularity of basketball is widespread, even to the extent that persons enjoy the recreation and competition of basketball while in a swimming pool. Earlier patents disclose basketball goals for use in a swimming pool which offer certain features. For example, U.S. Pat. No. 4,307,887 to Weiss discloses a pair of opposed basketball goals with a volleyball net suspended between the poles which are bolted along the edge of the pool. In FIG. 6 of the Weiss patent an alternative embodiment is disclosed which uses a plate to be affixed to the cement around the pool. U.S. Pat. No. 4,759,545 to Grable discloses a portable basketball goal next to a pool. A base is adapted to sit on the pool deck and internally receive water for ballast. Other basketball goals are disclosed in U.S. Pat. No. 4,793,611 to Thornell, U.S. Pat. No. 3,544,110 to Dickinson and U.S. Pat. No. 4,522,394 to Broussard. Such patents disclose various telescopic poles for basketball goals.

U.S. Pat. No. 4,465,227 to Dittrich discloses a basketball goal having an extended horizontal portion and designed for slam dunk shots. However, by the nature of water in a swimming pool, it is not well suited for slam dunk shots, especially with a high rim as disclosed in Dittrich.

The present invention is for in-ground swimming pools which, by their nature, are suited for basketball goals which are relatively low compared to conventional basketball goals. It is desirable to have the support structure for the goal firmly anchored in the ground to minimize movement of the goal by forces such as slam dunks, the ball bouncing off the goal, wind and the like. Although prior devices such as Weiss address this problem with anchors secured to the ground, such systems create disadvantages which the present invention overcomes. Specifically, it is desirable to have a sidewalk surrounding a swimming pool which is unimpeded by the basketball goal when it is not in use and which is clear of obstacles which a person could trip on and hurt themselves. The present invention overcomes these disadvantages of the prior art.

SUMMARY OF THE INVENTION

The present invention provides a basketball-type goal for an in-ground swimming pool having a paved sidewalk about at least three feet wide and adjacent the pool. A goal having a backboard with a basketball-type hoop projecting therefrom is connected to a support having a vertical component and an extended horizontal component. Anchor means for anchoring the support means to the ground are provided, wherein the anchor means is embedded underground and is located about at least three feet away from the in-ground pool and laterally outside the paved sidewalk away from the in-ground pool; wherein the support is movable with respect to the anchor means between a first position and a second position.

With the support in the first position, the extended horizontal component of the support means is greater than three feet and is sufficiently long to laterally traverse the sidewalk and to suspend the hoop over the in-ground pool, and has a portion which is less than six feet above the paved sidewalk which impedes pedestrian traffic along the sidewalk. The support is movable to the second position with the hoop away from the in-ground pool so that the paved sidewalk is free from impedance of pedestrian traffic by the horizontal component of the support.

The present invention also provides a basketball goal with means to allow selective vertical adjustment of the support means comprising a collar disposed around the support means, the collar having a set screw to tighten onto the support means, wherein the collar and the support means are selectively fixed with respect to each other.

One object of the present invention is to provide an improved poolside basketball goal for use with in-ground swimming pools.

Another object of the present invention is to provide a secure and stable poolside basketball goal which may be conveniently moved when not in use to remove impediments to pedestrian traffic.

These and other objects and advantages of the present invention will be apparent from the drawings and written description.

DESCRIPTION OF THE PREFERRED EMBODIMENT

Figure 1:
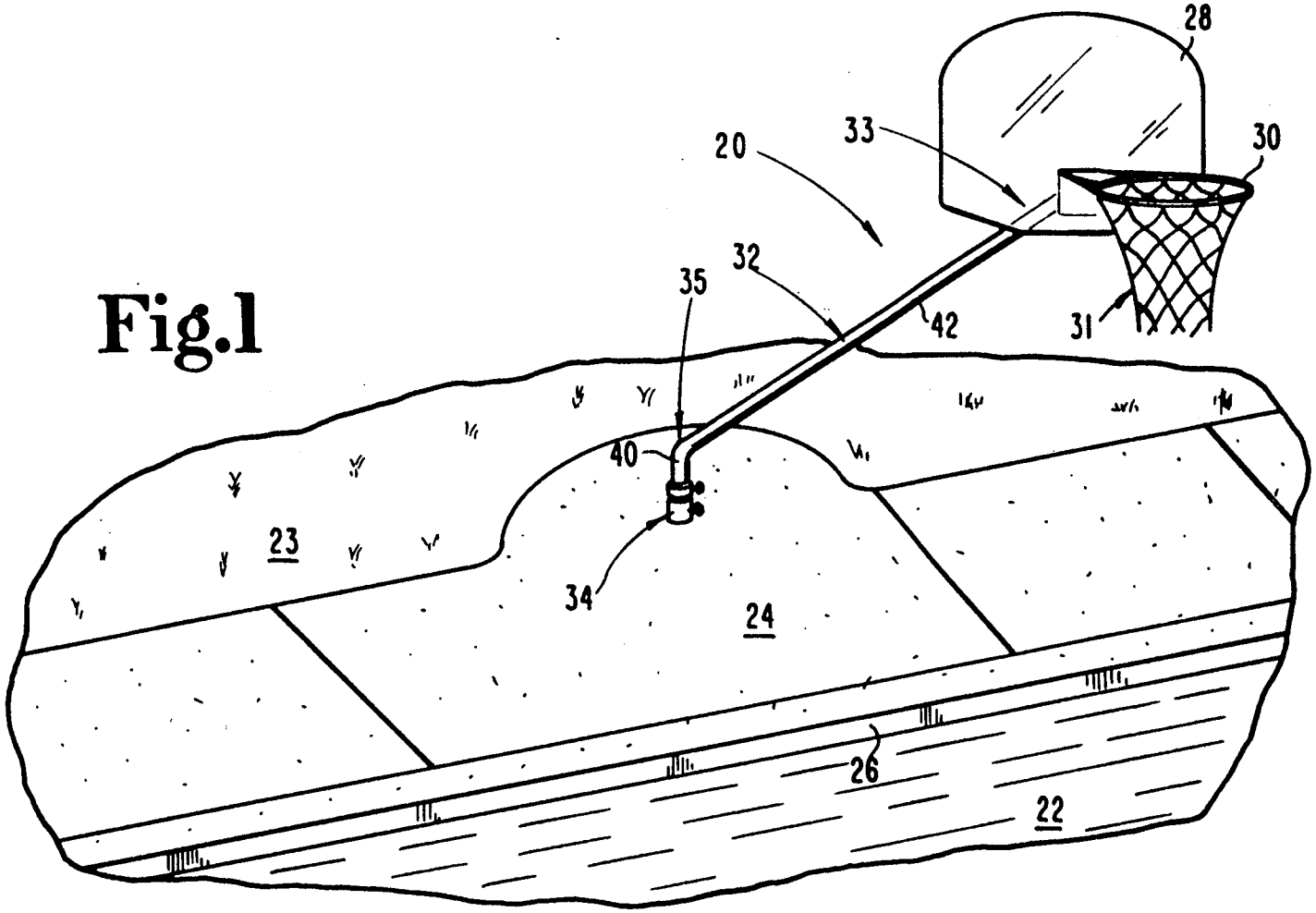
FIG. 1 is a perspective view of one embodiment of the present invention in a first position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawing figures, poolside basketball goal 20 is shown with in-ground swimming pool 22 which is located within the ground 23. Pool 22 has a paved sidewalk 24 typically made of concrete, asphalt or the like, which is adjacent the swimming pool. Sidewalk 24 is at least 3 feet wide at width W (see FIGS. 2 and 3) and typically is even wider than 3 feet. This width allows sufficient room for pedestrians to comfortably walk around the pool on the sidewalk. Pool 22 has pool wall 26 to contain the water.

Poolside basketball goal 20 has backboard 28 with a basketball type hoop 30 projecting therefrom in the ordinary manner. It is preferred, although not necessary, that the backboard be made of transparent acrylic material which is attractive and suitably lightweight and strong. The diameter of hoop 30 may vary according to design, but one acceptable design of backboard and hoop and net 31 are commercially available from Harvard Sports, Inc., 2640 East Del Amo Boulevard, Compton, Calif. 90221.

Figure 3:
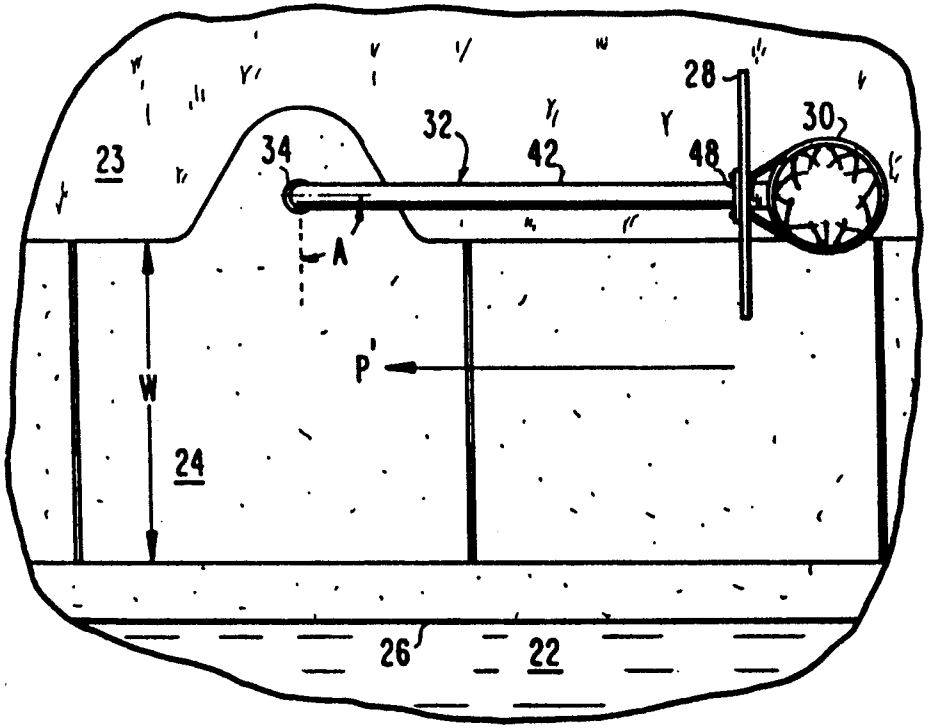
FIG. 3 is a top plan view of the device of FIG. 2 in a second position with the sidewalk free from impedance of pedestrian traffic P'.
Figure 2:
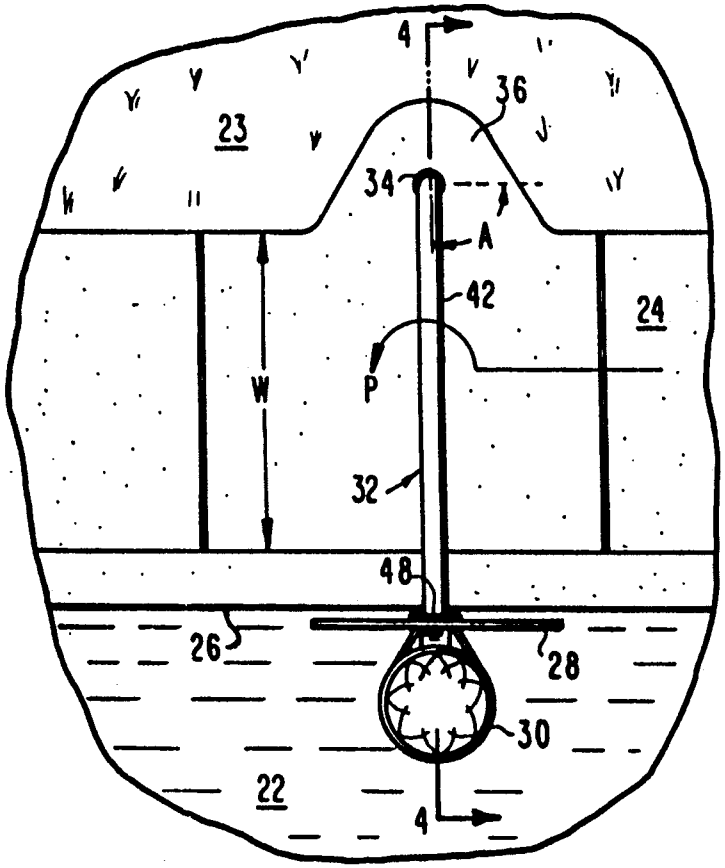
FIG. 2 is a top plan view of the device of FIG. 1 in a first position impeding pedestrian traffic P.

The backboard and hoop are supported by support 32 having a first end 33 and a second end 35. End 33 is attached to the backboard and hoop combination in any suitable fashion. In the preferred embodiment they are attached using a 3"×3" plate 48 welded to the support and having bolts connecting the plate to the backboard. Second end 35 of support 32 is anchored to the ground by anchor 34. Although a variety of anchor mechanisms may be used, the illustrated embodiment has anchor 34 embedded in concrete 36 which is typically deeper than the concrete making up sidewalk 24. As illustrated in FIGS. 1–3, concrete 36 may form a bulge away from sidewalk 24 and contiguous therewith. This conveniently allows for retrofit installation where the sidewalk has been previously installed.

Figure 4:
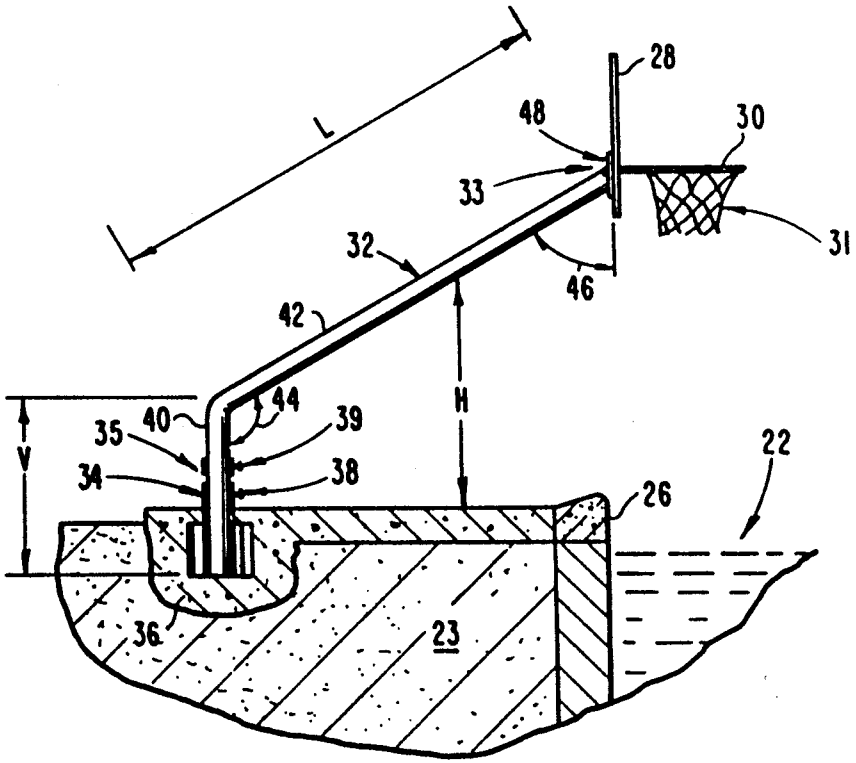
FIG. 4 is a side elevational view partially cut away of the present invention taken generally along line 4—4 in FIG. 2.

Although a variety of support designs may be used, the preferred embodiment utilizes a steel pole bent to make up vertical segment 40 and upwardly angular segment 42 which are oriented at about 120° angle 44 with respect to each other. Backboard 28 and upwardly angular segment 42 are oriented at about a 60° angle 46 with respect to each other. In the illustrated embodiment, vertical segment 40 is 3 feet long (see "V" in FIG. 4) and upwardly angular segment 42 is 5 feet long (see "L" in FIG. 4). Accordingly, upwardly angular segment 42 has a vertical component of 2.5 feet and a horizontal component of about 4.3 feet.

This horizontal component of support 32 is therefore extended such that it is greater than the 3 foot width W and is sufficiently long to traverse sidewalk 24 to suspend hoop 30 over the in-ground pool 22 (see FIG. 2). Furthermore, as set forth in the background, due to the desired characteristics of a swimming pool basketball goal being low, the extended or horizontal component of support 32 has a portion which has a heighth H (see FIG. 4) which is less than 6 feet above the paved sidewalk 24. This portion impedes pedestrian traffic P (see FIG. 2) by virtue of its relatively low heighth H.

However, comparison of FIG. 2 and FIG. 3 illustrates support member 32 being movable with respect to anchor 34 between a first position illustrated in FIG. 2 and a second position illustrated in FIG. 3. Although support 32 impedes pedestrian traffic P in the first position, it is movable to the second position with hoop 30 away from the in-ground pool 22 so that the paved sidewalk 24 is free from impedance by the horizontal component of the support member of pedestrian traffic P'. Accordingly, the support, backboard and goal may conveniently be moved away from the pool when not in use and allow relatively unobstructed pedestrian traffic. The present invention's movement is preferably by pivoting about a vertical axis through angle A, but may be accomplished by other means such as pivoting through a nonvertical axis, removal or other movement.

Figure 5:
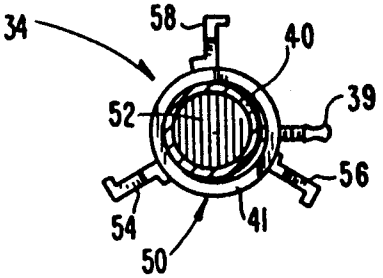
FIG. 5 is a top plan detail view of the anchor used in the present invention having a vertical segment of the support therein.
Figure 6:
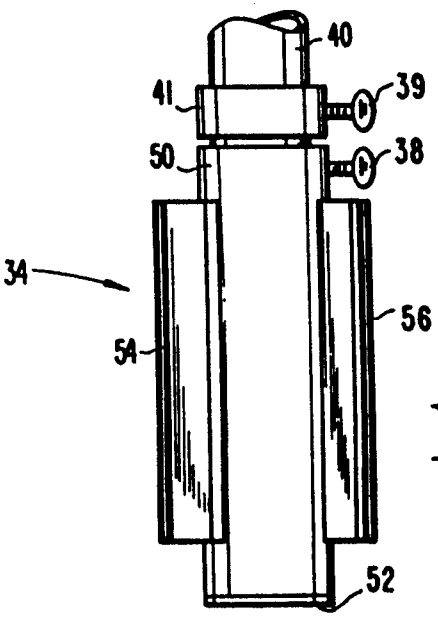
FIG. 6 is a side elevational detail view of the anchor of FIG. 5.
Figure 7:
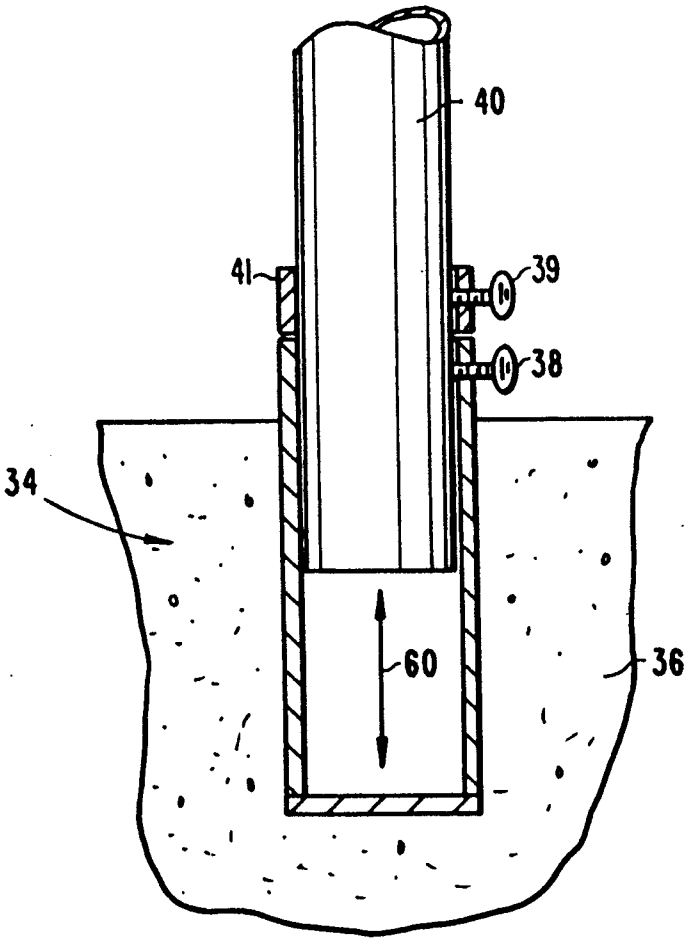
FIG. 7 is a side elevational detail view of the anchor of the present invention embedded in concrete and showing the telescopic movement of a vertical segment of the support with respect to the anchor.

Referring particularly to FIGS. 5–7, the preferred anchor 34 is illustrated in greater detail. Anchor 34 is made up of tube 50 made of 36 inch long 2 inch steel pipe with optional bottom plate 52 welded thereto to provide a bearing surface for vertical segment 40. Plate 52 may have drainage holes (not shown) for water. Preferably tube 50 includes three radial members 54, 56, and 58 as illustrated. These radial members help secure anchor 34 against axial twisting when embedded in the ground in concrete 36 as illustrated. A variety of designs may be used for the radial members but as illustrated, they comprise Z-shaped members 24" long with a 2½" web and ¾" flanges.

Set screw 38 is provided in a threaded hole ¾" from the top of tube 50. Set screw 38 may be tightened down to lock vertical segment 40 of the support against axial pivoting when the goal is in use and may be loosened for removal of the support or rotation thereof. Furthermore, collar 41 is disposed concentrically around vertical segment 40 of the support and has a threaded hole with a second set screw 39 disposed therein. Collar 41 may be made from a 1½ inch length of 2 inch pipe similar to the pipe used to make tube 50. The combination of set screw 39 and collar 41 allow the user to select a predetermined height for the goal by tightening down set screw 39, while allowing pivoting of the vertical segment in the anchor by loosening set screw 38 without changing the height. Thus, set screw 39 and collar 41 provide another mechanism to allow selective vertical adjustment (see arrow 60, FIG. 7) of the support and goal with vertical segment 40 being telescopically disposed with respect to tube 50 of the anchor. Set screws 38 and 39 may be replaced with other suitable locks such as spring-biased buttons which engage holes in tube 50 (not shown).

With a combination of features provided by the present invention, the anchor is embedded underground and is located about at least 3 feet away from in-ground pool 22 and laterally outside of paved sidewalk 24 away from the in-ground pool. In this way, anchor 34 is out of the path of pedestrian traffic and accordingly reduces the risk of a pedestrian tripping or otherwise hurting themselves on the anchor mechanism.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A basketball-type goal for an in-ground swimming pool having a paved sidewalk about at least three feet wide and adjacent the pool, comprising:

a goal having a backboard with a basketball-type hoop projecting therefrom;

support means having a first end and a second end, and further having a vertical component and an extended horizontal component between said first and second ends, said first end attachable to said goal;

anchor means for anchoring said second end of said support means to the ground, wherein said anchor means is embedded underground and is located about at least three feet away from the in-ground pool and laterally outside the paved sidewalk away from the in-ground pool;

wherein said support means is movable with respect to said anchor means between a first position and a second position;

wherein, with said support means in said first position, said extended horizontal component of said support means:

(a) is greater than three feet and is sufficiently long to laterally traverse the sidewalk and to suspend said hoop over the in-ground pool, and (b) has a portion thereof which is less than six feet above the paved sidewalk which impedes pedestrian traffic along the sidewalk; and wherein said support means is movable to said second position with said hoop away from the in-ground pool so that the paved sidewalk is free from impedance of pedestrian traffic by said horizontal component of said support means.

2. The goal of claim 1 and further comprising locking means for selectively locking said second end of said support means with respect to said anchor means in a selected angular position.

3. The goal of claim 2 wherein said second end is telescopically disposed with respect to said anchor means to allow selective vertical adjustment of said support means and said goal.

4. The goal of claim 3 wherein said support means comprises a pole which has a vertical segment projecting upwardly from said anchor means and an upwardly angular segment attached to said vertical segment, wherein said vertical segment and said angular segment are oriented at about a one hundred and twenty degree angle with respect to each other, and wherein said angular segment and said backboard are oriented at about a sixty degree angle with respect to each other.

5. The goal of claim 4 wherein said anchor means comprises a vertical tube having a plurality of radial members projecting therefrom to resist rotation of said tube about a vertical axis.

6. The goal of claim 5 wherein said backboard is made from transparent acrylic plastic.

7. The goal of claim 6 wherein said means to allow selective vertical adjustment of said support means comprises a collar disposed around said support means, said collar having a set screw to tighten onto said support means, wherein said collar and said support means are selectively fixed with respect to each other.

8. The goal of claim 1 wherein said support means comprises a pole which has a vertical segment projecting upwardly from said anchor means and an upwardly angular segment attached to said vertical segment, wherein said vertical segment and said angular segment are oriented at about a one hundred and twenty degree angle with respect to each other, and wherein said angular segment and said backboard are oriented at about a sixty degree angle with respect to each other.

9. The goal of claim 1 wherein said anchor means comprises a vertical tube having a plurality of radial members projecting therefrom to resist rotation of said tube about a vertical axis.

10. The goal of claim 1 wherein said backboard is made from transparent acrylic plastic.

11. The goal of claim 1 wherein said second end is telescopically disposed with respect to said anchor means to allow selective vertical adjustment of said support means and said goal.

12. The goal of claim 11 wherein said means to allow selective vertical adjustment of said support means comprises a collar disposed around said support means, said collar having a set screw to tighten onto said support means, wherein said collar and said support means are selectively fixed with respect to each other.

* * * * *